US007434965B2

(12) United States Patent
Webb

(10) Patent No.: US 7,434,965 B2
(45) Date of Patent: Oct. 14, 2008

(54) REFLECTOR FOR A LINEAR LIGHT SOURCE AND LOUVRE CONTROLLER INCORPORATING THE SAME

(76) Inventor: Steven Peter Webb, 105 South Primrose Hill, Chelmsford, Essex (GB) CM1 2RG ( * ) Notice: Subject to any disclaimer, the term of this patent is extended or adjusted under 35 U.S.C. 154(b) by 212 days.

(21) Appl. No.: 10/433,874

(22) PCT Filed: Dec. 4, 2001

(86) PCT No.: PCT/GB01/05367

§ 371 (c)(1),
(2), (4) Date: Jun. 3, 2003

(87) PCT Pub. No.: WO02/46660

PCT Pub. Date: Jun. 13, 2002

(65) Prior Publication Data

US 2004/0042214 A1 Mar. 4, 2004

(30) Foreign Application Priority Data

Dec. 4, 2000 (GB) ..... 0029532.9

(51) Int. Cl.
*F21V 11/06* (2006.01)

(52) U.S. Cl. ..... 362/341; 362/342; 362/346

(58) Field of Classification Search ..... 362/341, 362/342, 346, 347, 354
See application file for complete search history.

(56) References Cited

U.S. PATENT DOCUMENTS

| | | | |
|---|---|---|---|
| 5,528,478 | A | 6/1996 | Degelmann |
| 5,758,954 | A | 6/1998 | Holten et al. |

FOREIGN PATENT DOCUMENTS

| | | |
|---|---|---|
| EP | 0138747 | 4/1985 |
| FR | 2734044 | 11/1996 |
| FR | 2738623 | 3/1997 |

*Primary Examiner*—Anabel M Ton
(74) *Attorney, Agent, or Firm*—McDonnell Boehnen Hulbert & Berghoff LLP

(57) ABSTRACT

A louvre controller for a linear light source has plural transverse reflectors 33 and each located between side reflectors 31, 32. The transverse reflectors have arcuate surfaces forming a double concave reflector and a base 38 of the transverse reflectors is profiled to provide predetermined vertical cut-off angles for all horizontal angles of azimuth.

22 Claims, 11 Drawing Sheets

REFLECTOR FOR A LINEAR LIGHT SOURCE AND LOUVRE CONTROLLER INCORPORATING THE SAME

BACKGROUND OF THE INVENTION (1) Field of the Invention

This invention relates to a reflector for a linear light source and to a louvre controller including a reflector.

(2) Description of the Related Art

Linear light sources, for example linear fluorescent lamps, are known which use a louvre controller having profiled side reflectors and transverse reflectors.

A perspective top view of a known louvre controller is shown in FIG. 1, having opposed generally arcuate side reflectors 10, 11, which extend parallel to an axial direction indicated by arrow headed line 12, of a linear light source 21. Disposed in a transverse direction (as shown by arrow headed line 13) are plural profile transverse reflectors 14, ten such transverse reflectors being shown in the exemplary embodiment of FIG. 1. It is to be understood that fewer or more transverse reflectors 14 may be provided in dependence upon the length of the linear light source.

A perspective underside view of a single known transverse reflector is shown in FIG. 2. The transverse reflector, shown in FIG. 2, is formed from a folded sheet of metal and has two opposed generally arcuate side surfaces 16, 17, the fold between the surfaces 16, 17 forming a straight knife edge 18. An upper portion of each of the side surfaces 16, 17 is relieved with a V-shaped groove 19, 20 for accommodating the linear light source 21.

The geometry of the louvre controller is determined so as to limit the intensity of light beyond required angles and the limitation is created by providing cut-off angles to prevent direct light from the light source being viewed.

FIG. 3 shows a diagrammatic end view of a louvre controller in which the side reflectors 10, 11 create a cut-off angle A in a transverse direction from the linear light source 21.

FIG. 4 shows, in diagrammatic form, a side view of a louvre controller in which the transverse reflectors 14 create a cut-off angle B in the axial direction. The angles A and B may be the same or different to one another.

It is, however, also necessary to control the intensity of light through all angles of azimuth, i.e. through 360° of the horizontal plane. In order to achieve such a function, the transverse reflectors are moved closer together to limit the direct light between the transverse and axial directions. In other words, the spacing, or pitch P, between the transverse reflectors is reduced.

For clarity, the horizontal plane showing 360° of azimuth is shown in a top plan view of FIG. 5 where the angles of azimuth are referenced 25. FIG. 6 shows a side view of a louvre controller which is helpful in understanding cut-off angles in which the vertical cut-off angle C is shown and the azimuthal volume described thereby, in which there is to be no direct view of the linear light source (shown by cross-hatched lines 26).

From the foregoing it will be understood it is necessary to provide cut-off angles not only in the axial 12 and transverse 13 directions, but also for vertical cut-off angles C for horizontal azimuthal angles 25.

Because the transverse reflector pitch P is necessarily reduced to achieve cut-off in axial, transverse and azimuth directions, the number of transverse reflectors along the axial length of the linear light source is increased. The transverse reflectors, although useful in the control of light, also create obstructions and, therefore, reduce the light output of the louvre controller. This reduction in light output is termed as a loss in light output ratio (LOR).

BRIEF SUMMARY OF THE INVENTION

The present invention seeks to provide a reflector for a linear light source and a louvre controller utilizing such a reflector which is capable of providing the same cut-off angles as the prior art, but yet increase the pitch spacing between the transverse reflectors.

According to a first aspect of this invention there is provided a reflector for arrangement transverse to a longitudinal axis of a linear light source, said reflector comprising opposed arcuate surfaces forming a double concave reflecting means having an axis arranged in use to be substantially parallel with said longitudinal axis, said arcuate surfaces having outer ends which are spaced apart from one another, said ends being joined by respective wall means, and said arcuate surfaces being joined by a double concavely curved base portion conforming to the contours of the adjoining arcuate surfaces.

Preferably, said wall means is arranged to extend in a plane parallel to said longitudinal axis.

Preferably, each said arcuate surface has a parabolic shape.

Advantageously, said arcuate surfaces have a portion arranged to be adjacent said linear light source in use in which is provided an aperture for accommodating said light source.

Advantageously, said reflector is injection molded from plastics material or fabricated metal material, e.g. aluminum.

Advantageously, said base portion is convexly curved in a direction orthogonal to said longitudinal axis and in a direction away from said aperture. Conveniently said convex curve may be elliptical or circular or any other convenient radiused shape.

According to a second aspect of this invention there is provided a louvre controller for a linear light source having a longitudinal like axis, said louvre controller including plural transverse reflectors each arranged to be transverse to the longitudinal axis of said linear light source, each reflector having opposed arcuate surfaces forming a double concave reflecting means having an axis arranged in use to be substantially parallel with said longitudinal axis, said arcuate surfaces having outer ends which are spaced apart from one another, said ends being joined by respective wall means, said arcuate surfaces being joined by a double concavely curved base portion conforming to the contours of the adjoining arcuate surfaces and at least one pair of side reflectors, each side reflector of said pair of side reflectors being arranged to be located on a respective end wall means of the transverse reflectors, and said side reflectors extending substantially parallel to said longitudinal axis, whereby light from said light source is cut-off by said transverse and side reflectors for predetermined vertical cut-off angles for all horizontal angles of azimuth.

Preferably, said predetermined angle is in the range 30°-85° and, preferably, one of 55°, 65° or 75°.

Preferably, said arcuate surfaces are joined by a base member forming said base portion arranged to be remote from said light source, the profile of said base member being determined by a predetermined position of said light source, the position of said side reflectors and the profile of said arcuate surfaces.

Advantageously, the side reflectors are generally arcuate and are spaced from the light source to provide light cut-off in a transverse direction.

Advantageously, said arcuate surfaces have a portion arranged to be adjacent said linear light source in use in which is provided an aperture for accommodating said light source.

Conveniently, the spacing between said transverse reflectors is determined by the minimum height of said arcuate surfaces.

Normally, said minimum height is at a transverse midpoint of said reflector.

Preferably, a cut-off angle in an axial direction is determined by an imaginary line between a point closest to the light source on one transverse reflector to a point furthest from the light source on an adjacent transverse reflector.

Preferably, each said arcuate surface has a parabolic shape.

Advantageously, each said reflector is injection molded from plastics material or fabricated metal material.

In an alternative embodiment, two or more louvre controllers may be joined in a transverse or longitudinal direction.

Advantageously, said base portion is convexly curved in a direction orthogonal to said longitudinal axis and in a direction away from said light source when in use.

Conveniently said convex curve may be elliptical or circular or any other convenient radiused shape.

According to a third aspect of this invention there is provided a louvre controller as defined in said second aspect in combination with a linear light source.

BRIEF DESCRIPTION OF THE DRAWINGS

The invention will now be described, by way of example, with reference to the accompanying drawings, in which.

In the Figures, like reference numerals denote like parts.

DETAILED DESCRIPTION OF THE INVENTION

Figure 1:
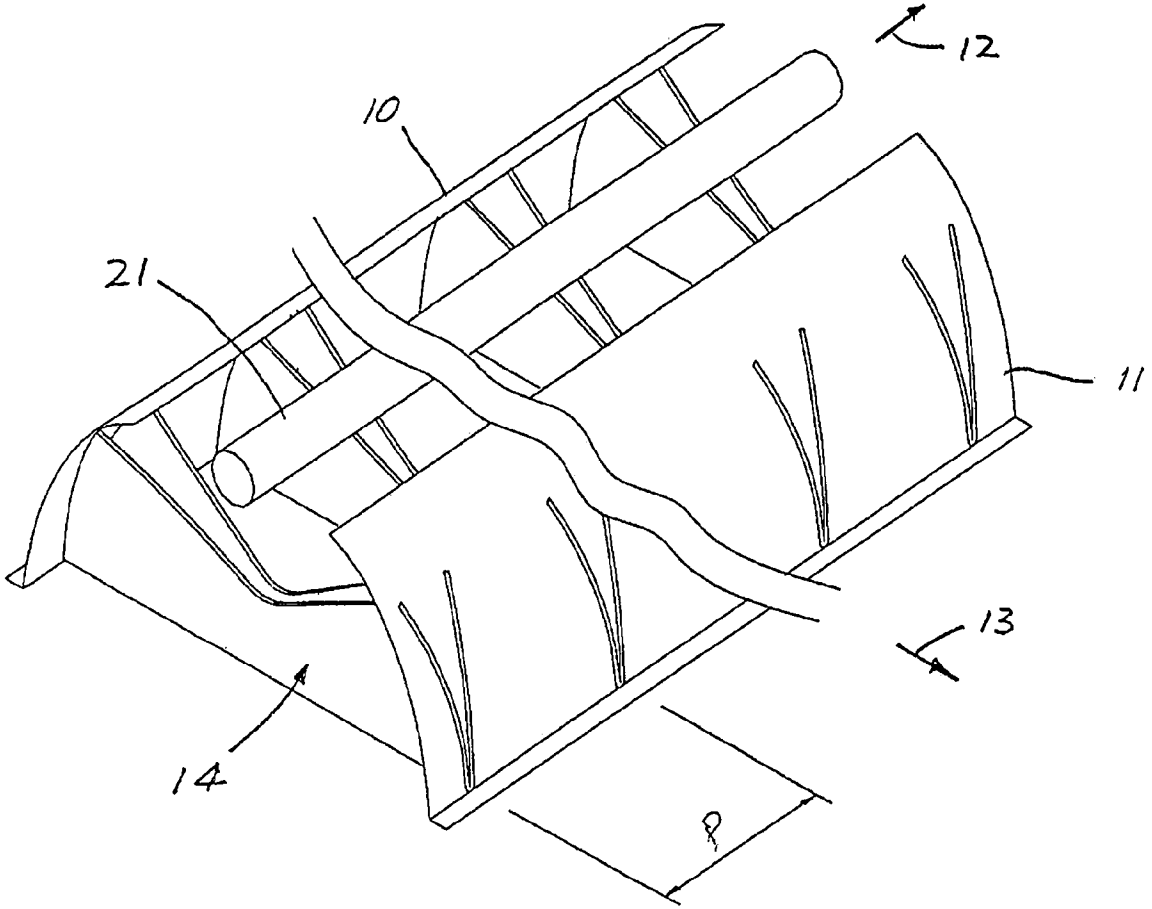
FIG 1 PRIOR ART
FIG. 1 shows a perspective top view of a known louvre controller.
Figure 12:
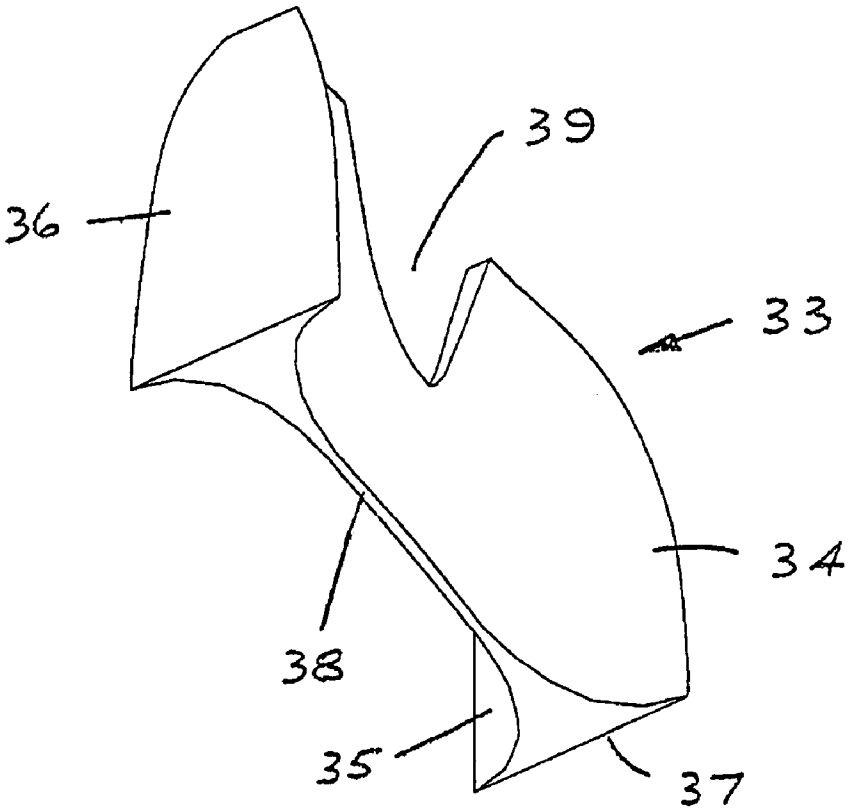
FIG. 12 shows a transverse reflector in accordance with this invention.
Figure 2:
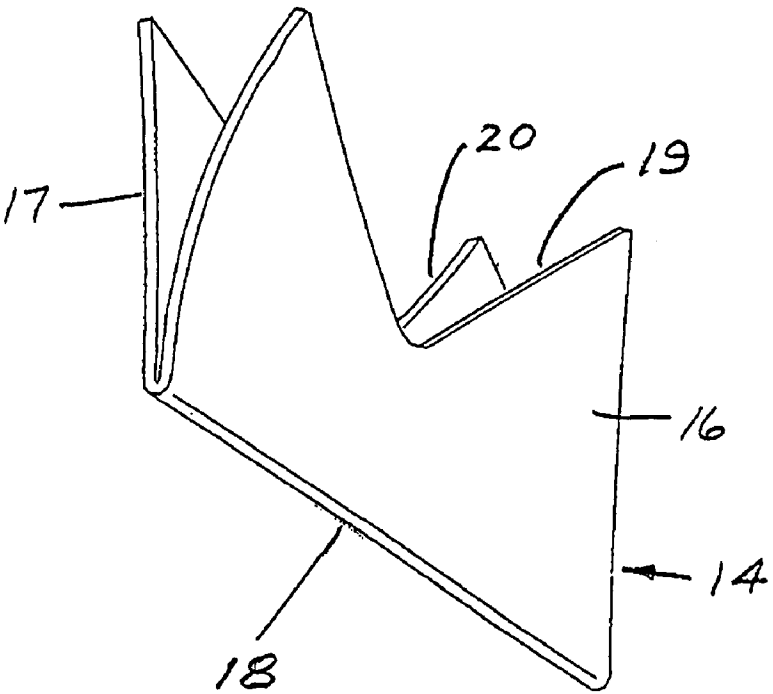
FIG 2 PRIOR ART
FIG. 2 shows a perspective underside view of a known transverse reflector.
Figure 3:
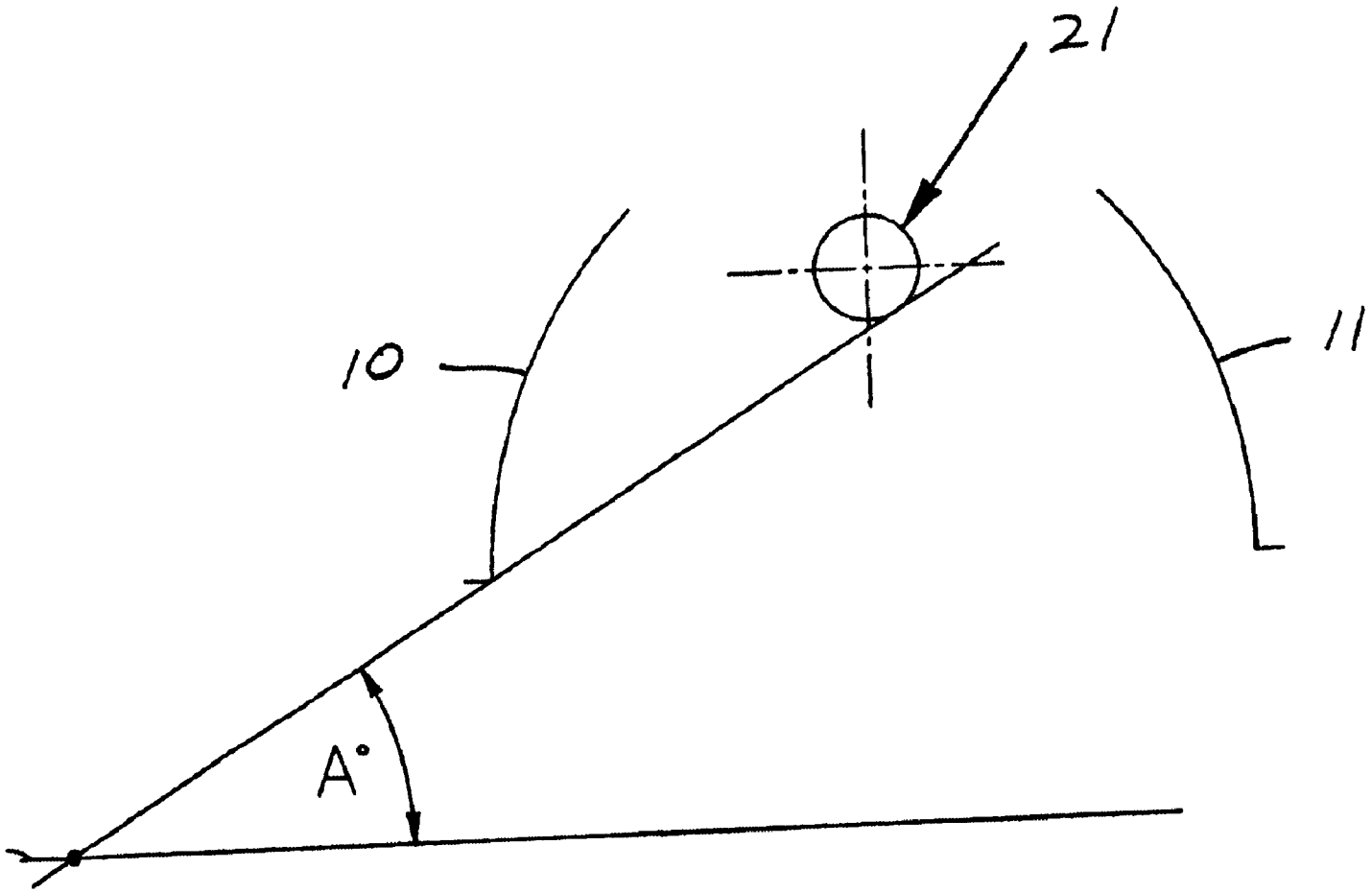
FIG. 3 shows a diagrammatic end view of a louvre controller useful in describing cut-off angle in the transverse direction.
Figure 4:
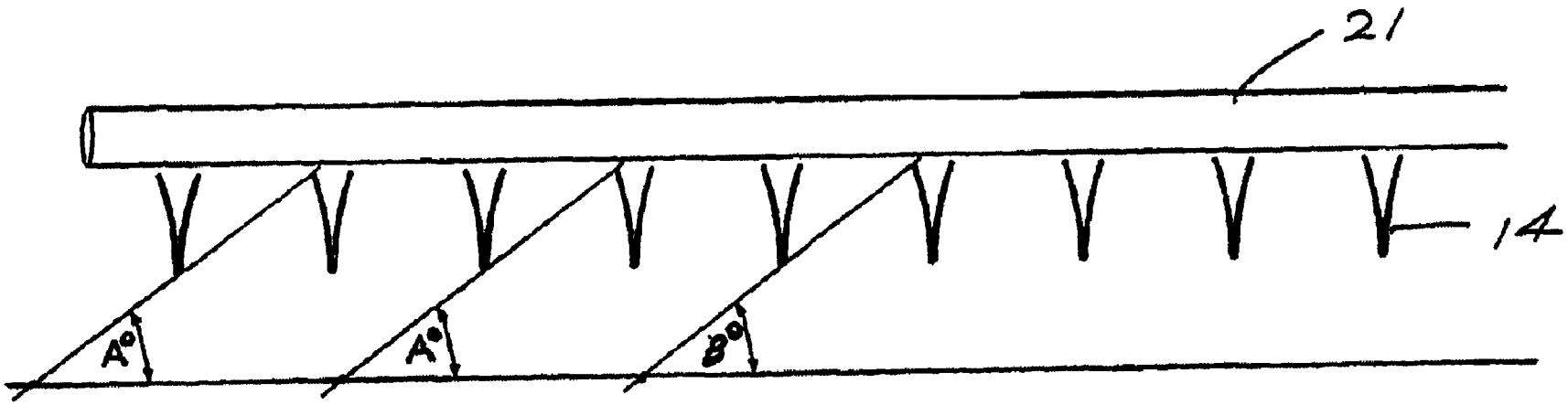
FIG. 4 shows a diagrammatic side view of a louvre controller useful in describing a cut-off angle in the axial direction.
Figure 5:
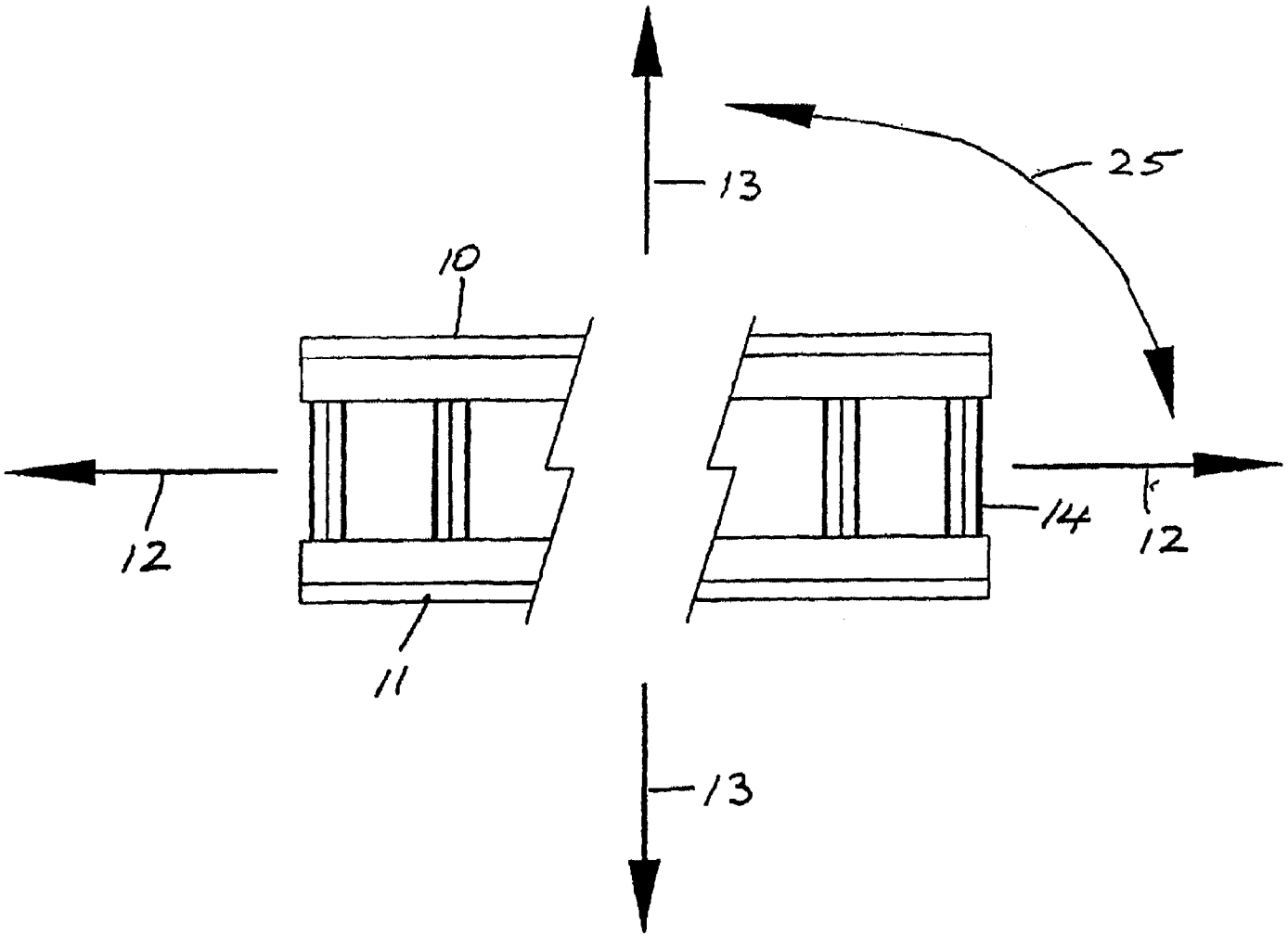
FIG. 5 shows a top plan view useful in understanding azimuthal cut-off angles.
Figure 6:
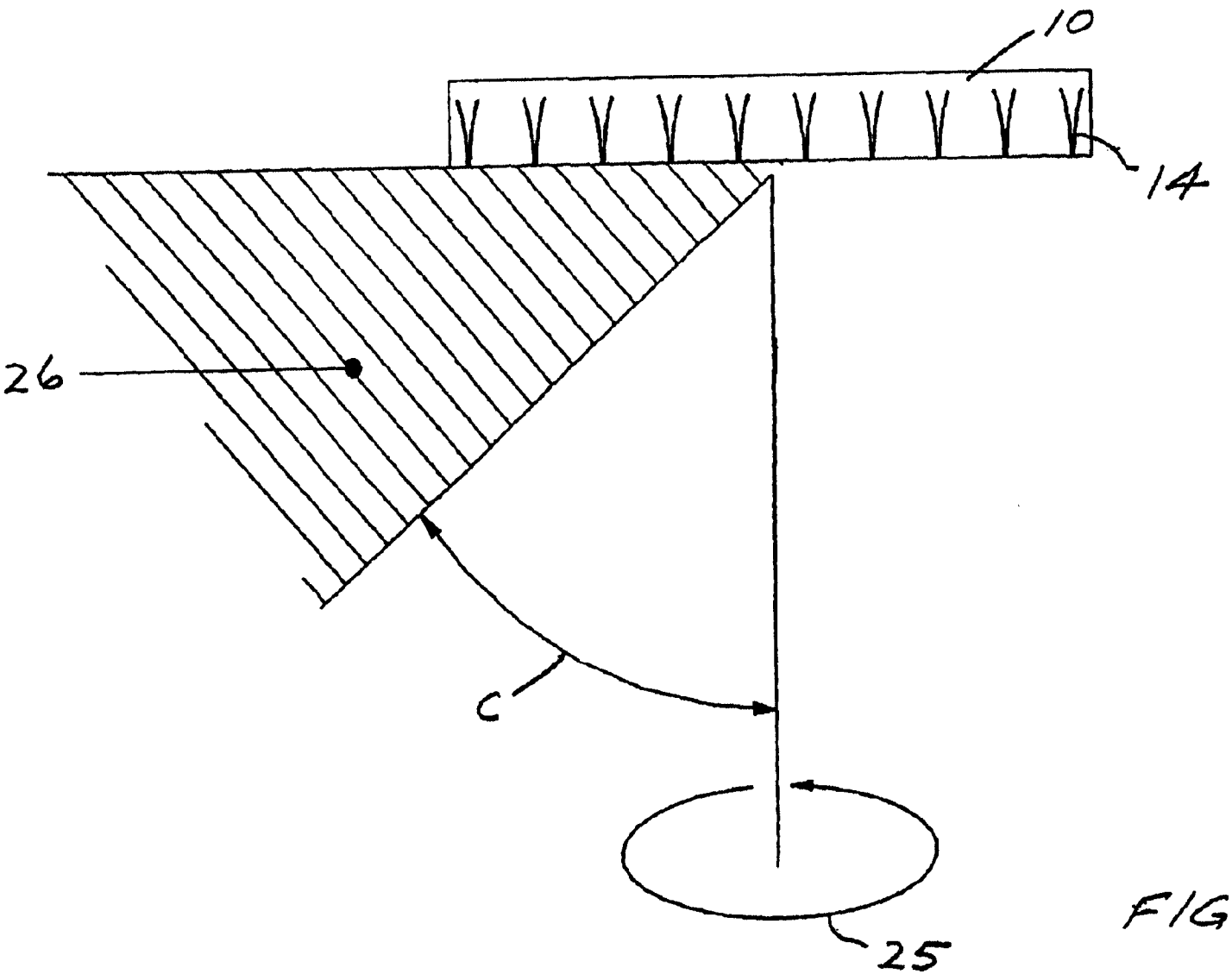
FIG. 6 shows a side view of a louvre controller useful in understanding vertical cut-off angles required for all angles of azimuth.
Figure 7:
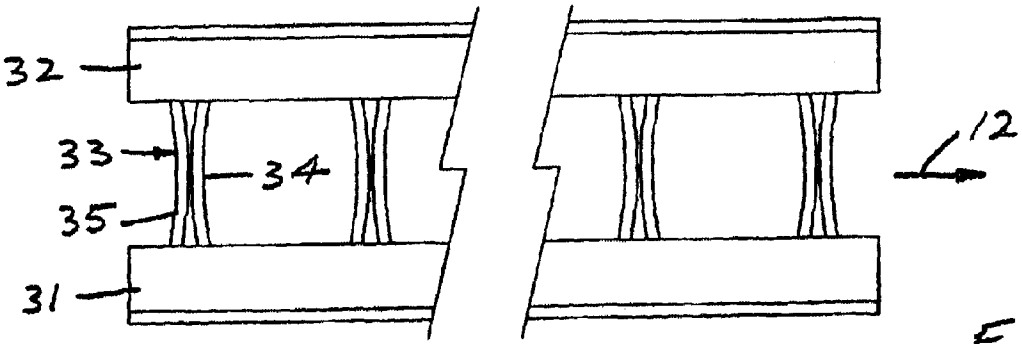
FIGS. 7-10 show mutually orthogonal underside, side, top and end views of a louvre controller in accordance with this invention.
Figure 8:
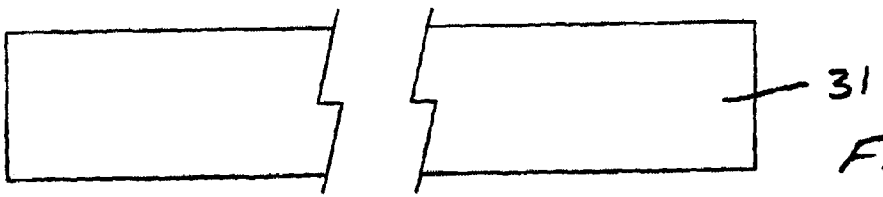
Figure 9:
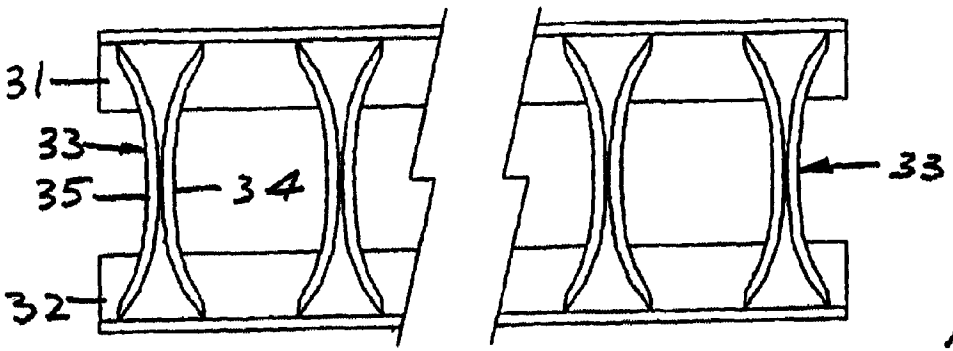
Figure 10:
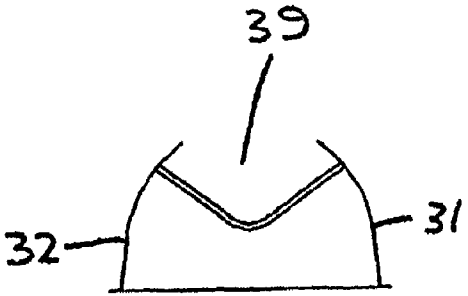
Figure 11:
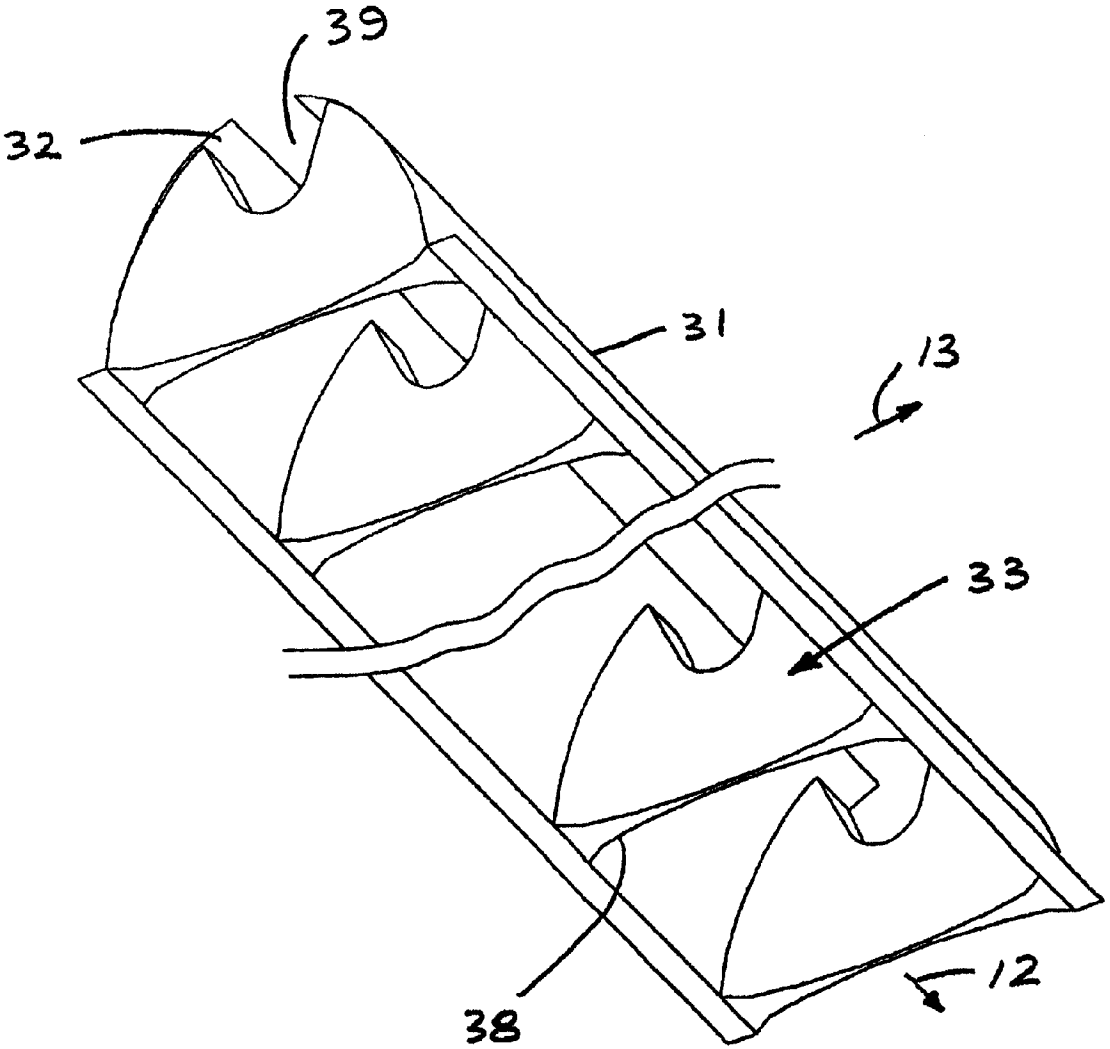
FIG. 11 shows a perspective underside view of a louvre controller in accordance with this invention.

The louvre controller shown in FIGS. 7-11 has a pair of side reflectors 31, 32 which extend substantially parallel to the longitudinal axis 12 of a linear light source (not shown) and the side reflectors are generally arcuate but may be formed of three straight edges, as shown in FIG. 10. Disposed between the side reflectors are six transverse reflectors 33, although it is to be understood that fewer or more transverse reflectors may be employed in dependence upon the length of the light source. Each of the transverse light reflectors 33, shown particularly in FIG. 12, have opposed arcuate side surfaces 34, 35 forming a double concave reflector with an axis thereof arranged substantially parallel to the longitudinal axis of the linear light source. The arcuate surfaces 34, 35 have outer ends which are spaced apart and which are joined by opposed walls 36, 37 that abut, and are fixed to, a respective side reflector 31, 32 by any convenient known means, such as adhesive.

A base portion 38 of the transverse reflector is profiled in the horizontal plane to provide azimuthal cut-off angles between the axial and transverse directions 12, 13. An upper portion of the surfaces 34, 35 adjacent the light source is provided with an aperture 39 to accommodate the light source.

The profile of the base portion 38 is dimensioned so as to prevent direct view of the light source above a predetermined vertical cut-off angle. The shape of the base profile is determined by the position of the light source, the position of the side reflectors, and the shape of the transverse reflector upper profile. The profile of the base is calculated to provide optimum LOR results.

The spacing (pitch P) is determined by the minimum height of the arcuate surfaces 34, 35, normally at a transverse midpoint of the surfaces. The cut-off angle in an axial direction is determined by a line between a point closest to the light source on one transverse reflector to a point furthest from the light source on an adjacent transverse reflector. The base portion profile is gradually widened from its transverse centre to increase toward the ends 36, 37 so as to provide cut-off angles that are desired in azimuth. The resulting shape of the surfaces 34, 35 may be parabolic or some other form of ellipsoid curve.

By utilization of a transverse reflector having a profiled base, thereby having arcuate side surfaces, the pitch P between transverse reflectors may be increased without detriment to the light cut-off angle and because the number of reflectors required is reduced, so the LOR is increased. The profile of the transverse reflector base is calculated to provide optimum LOR results.

Typically, where a prior art controller required ten transverse reflectors, the present controller requires only six transverse reflectors. The reduction in quantity of transverse reflectors results in a reduction of component material cost.

The transverse reflectors may be molded of plastics material or fabricated metal material, e.g. aluminum.

Figure 13:
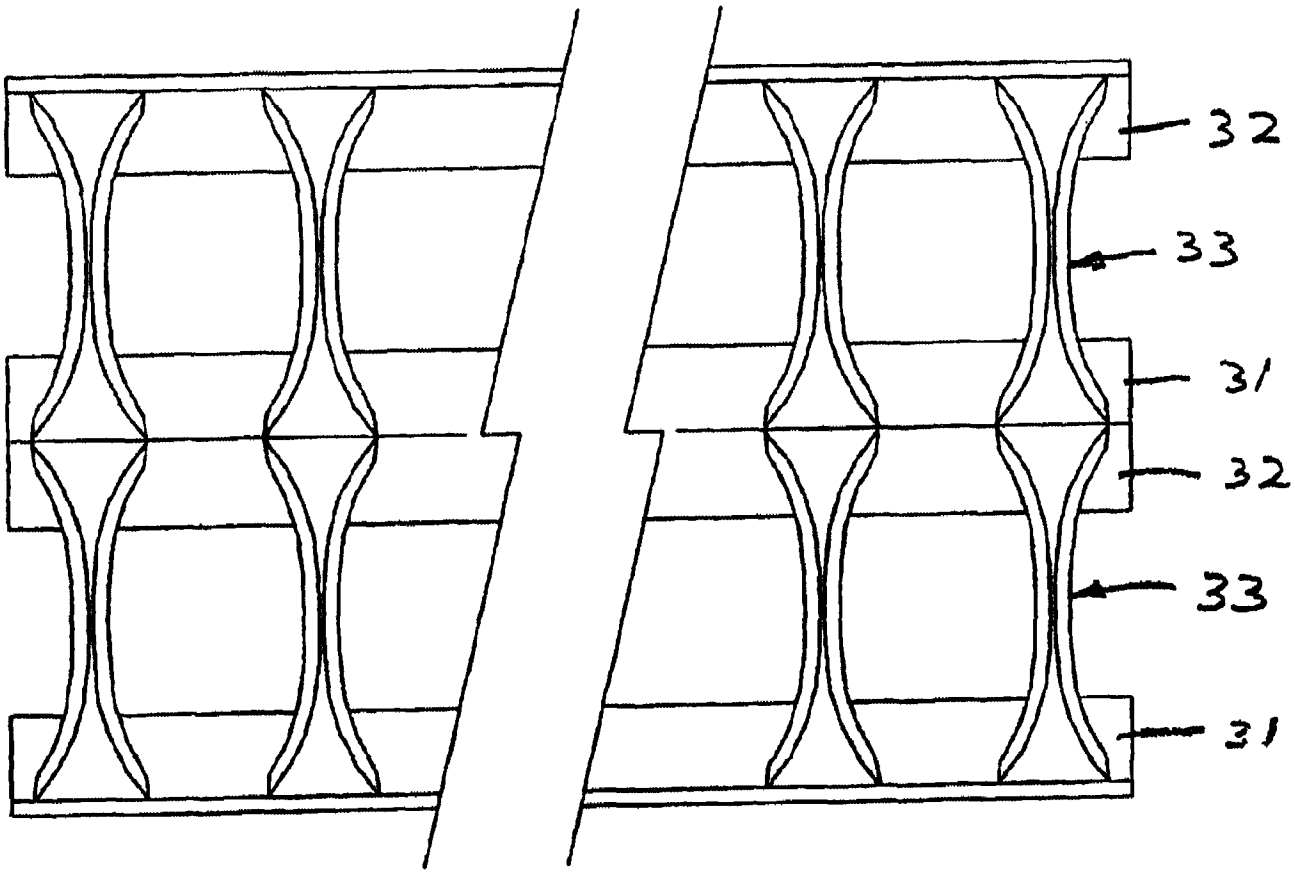
FIG. 13 shows an underside view of a double louvre controller in accordance with another embodiment of this invention.
Figure 14:
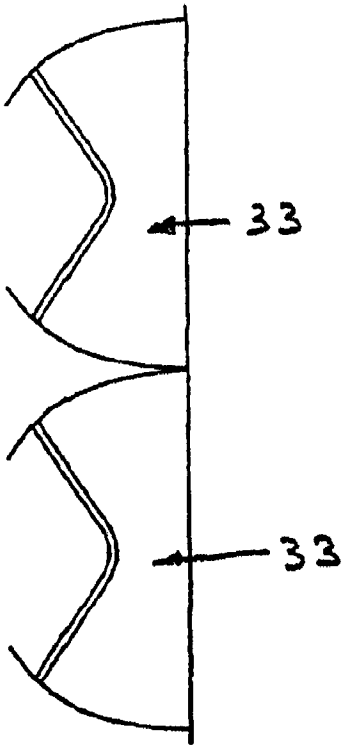
FIG. 14 shows an end view of the louvre controller shown in FIG. 13.
Figure 15:
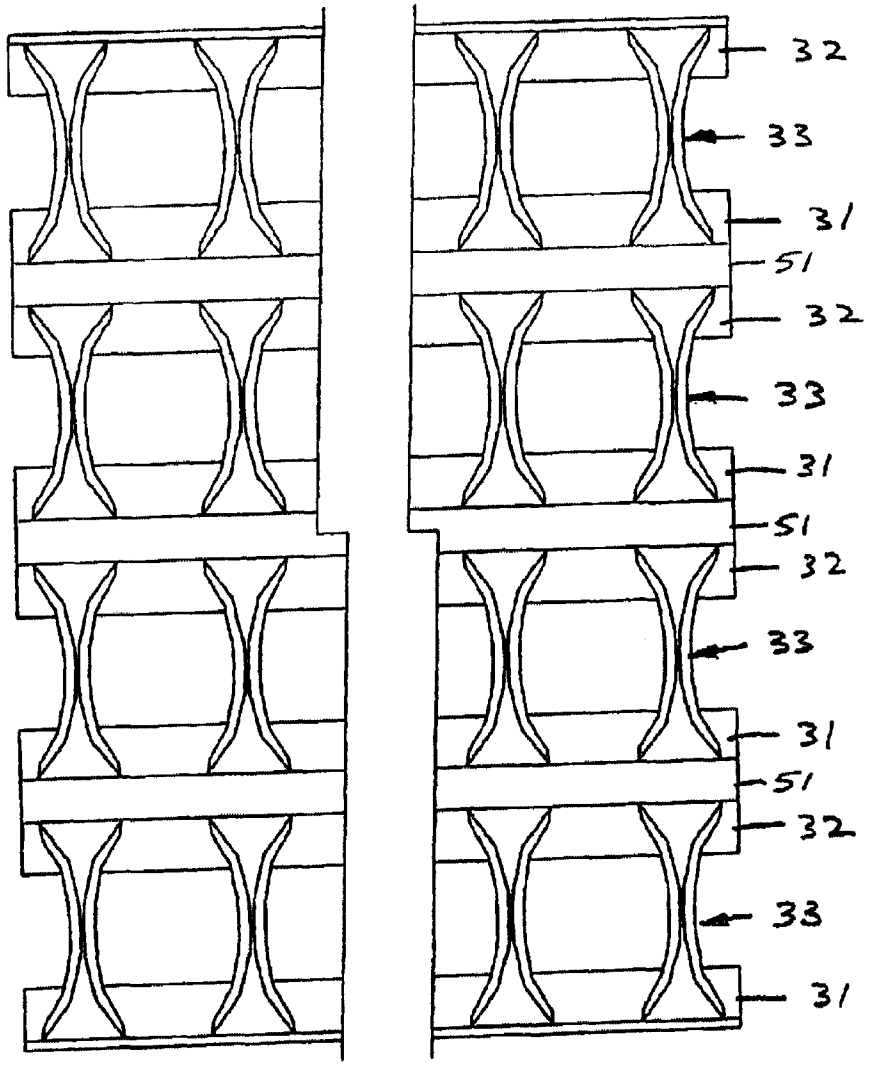
FIG. 15 shows an underside view of a quadruple louvre controller in accordance with a further embodiment of this invention.
Figure 16:
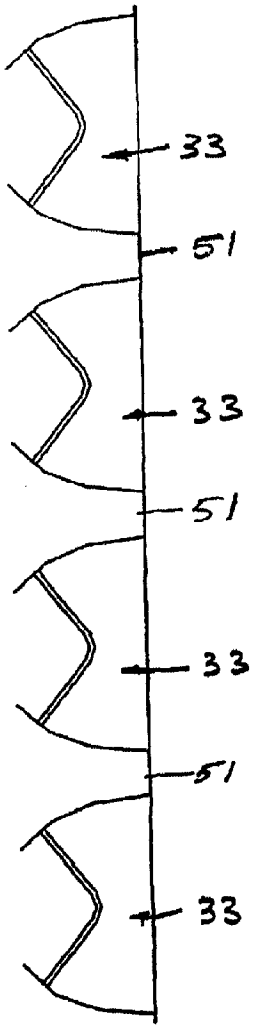
FIG. 16 shows an end view of the louvre controller shown in FIG. 15.
Figure 17:
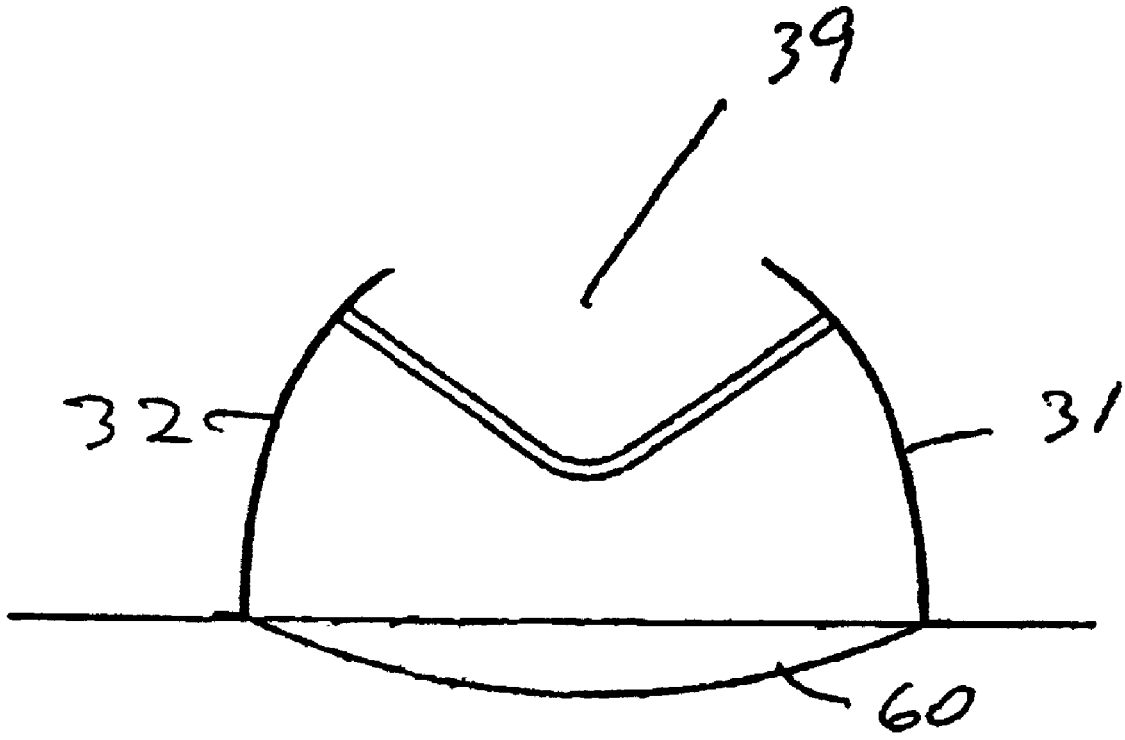
FIG. 17 shows a view similar to FIG. 10 but in which a base portion is convexly curved.

It will be appreciated by those skilled in the art that two or more louvre controllers may be joined either in a transverse and/or longitudinal direction in dependence upon the light output required and shape of light fitting required. A double louvre controller in which the controllers are located side-by-side, i.e. transversely, is shown in FIGS. 13 and 14, and a quadruple louvre controller is shown in FIGS. 15 and 16. In the embodiment of FIGS. 15 and 16 a spacer 51 is provided between adjacent side reflectors of different controllers, The embodiment shown in FIG. 17 has a base portion which is arcuate in a convex direction to form a convexly curved portion 60. The curve of the convex portion may be elliptical, circular or any other suitable shape. It is to be found that such a curve profile enhances photometric performance.

I claim:

1. A reflector for arrangement transverse to a longitudinal axis of a linear light source, said reflector comprising opposed arcuate surfaces forming a double concave reflecting surface having an axis arranged in use to be substantially parallel with said longitudinal axis, and opposed edges transverse to said axis terminating in outer ends which are spaced apart from one another, said ends being joined by respective walls, and said arcuate surfaces being joined by a double concavely curved base portion conforming to the contours of the adjoining arcuate surfaces, and said base portion being covexly curved in a direction orthogonal to said longitudinal axis and in a direction which in use is away from the light source.

2. A reflector as claimed in claim 1 wherein said walls are arranged to extend in a plane parallel to said longitudinal axis.

3. A reflector as claimed in claim 1 wherein each said arcuate surface has a parabolic shape.

4. A reflector as claimed in claim 1 wherein said arcuate surfaces have a portion arranged to be adjacent said linear light source in use in which is provided an aperture for accommodating said light source.

5. A reflector as claimed in claim 1 wherein said reflector is one of injection moulded from plastics material and fabricated from metal material.

6. A reflector as claimed in claim 1 wherein said convex curve may be one of elliptical, or circular, and any other convenient radiused shape.

7. A louvre controller for a linear light source having a longitudinal like axis, said louvre controller including plural transverse reflectors each arranged to be transverse to the longitudinal axis of said linear light source, each reflector having opposed arcuate surfaces forming a double concave reflecting surface, said arcuate surfaces having an axis arranged in use to be substantially parallel with said longitudinal axis and outer ends which are spaced apart from one another, said ends being joined by respective walls, said arcuate surfaces being joined by a double concavely curved base portion conforming to the contours of the adjoining arcuate surfaces, said base portion being convexly curved in a direction orthogonal to said longitudinal axis and in a direction away from said light source when in use, at least one pair of side reflectors, each side reflector of said pair of side reflectors being arranged to be located on a respective end wall of the transverse reflectors, and said side reflectors extending substantially parallel to said longitudinal axis, wherein light from said light source is cut-off by said transverse and side reflectors for predetermined vertical cut-off angles for all horizontal angles of azimuth.

8. A louvre controller as claimed in claim 7 wherein said predetermined angle is in the range 30°-85°.

9. A louvre controller as claimed in claim 8 wherein said predetermined angle is one of 55°, 65° or 75°.

10. A louvre controller as claimed in claim 7 wherein said arcuate surfaces are joined by a base member forming said base portion arranged to be remote from said light source, the profile of said base member being determined by a predetermined position of said light source, the position of said side reflectors and the profile of said arcuate surfaces.

11. A louvre controller as claimed in claim 7 wherein the side reflectors are generally arcuate and are spaced from the light source to provide light cut-off in a transverse direction.

12. A louvre controller as claimed in claim 7 wherein said arcuate surfaces have a portion arranged to be adjacent said linear light source in use in which is provided an aperture for accommodating said light source.

13. A louvre controller as claimed in claim 7 wherein the spacing between said transverse reflectors is determined by the minimum height of said arcuate surfaces.

14. A louvre controller as claimed in claim 13 wherein said minimum height is at a transverse mid-point of said reflector.

15. A louvre controller as claimed in claim 7 wherein a cut-off angle in an axial direction is determined by an imaginary line between a point closest to the light source on one transverse reflector to a point furthest from the light source on an adjacent transverse reflector.

16. A louvre controller as claimed in claim 7 wherein each said arcuate surface has a parabolic shape.

17. A louvre controller as claimed in claim 7 wherein each said reflector is one of injection moulded from plastics material and fabricated from metal material.

18. A louvre controller as claimed in claim 7 wherein two or more louvre controllers are joined in one of a transverse and a longitudinal direction.

19. A louvre controller as claimed in claim 7 wherein said convex curve may be one of elliptical, circular, and any other convenient radiused shape.

20. A louvre controller as claimed in claim 7 in combination with a light source.

21. A reflector for arrangement transverse to a longitudinal axis of a linear light source, said reflector comprising opposed arcuate surfaces forming a double concave reflecting surface having an axis arranged in use to be substantially parallel with said longitudinal axis and opposed edges transverse to said axis terminating in outer ends which are spaced apart from one another, said ends being joined by respective walls, and said arcuate surfaces being joined by a double concavely curved base portion conforming to the contours of the adjoining arcuate surfaces, and said base portion being convexly curved in a direction orthogonal to said longitudinal axis and in a direction which in use is away from the light source, wherein said arcuate surfaces have a portion arranged to be adjacent said linear light source in use in which is provided an aperture for accommodating said light source.

22. A reflector for arrangement transverse to a longitudinal axis of a linear light source, said reflector comprising opposed arcuate surfaces forming a double concave reflecting surface having an axis arranged in use to be substantially parallel with said longitudinal axis and opposed edges transverse to said axis terminating in outer ends which are spaced apart from one another, said ends being joined by respective walls, sand said arcuate surfaces being joined by a double concavely curved base portion conforming to the contours of the adjoining arcuate surfaces, and said base portion being convexly curved in a direction orthogonal to said longitudinal axis and in a direction which in use is away fro the light source, wherein said convex curve may be one of elliptical, circular, and any other convenient radiused shape.

* * * * *